US010544950B2

(12) United States Patent
McFadden et al.

(10) Patent No.: US 10,544,950 B2
(45) Date of Patent: Jan. 28, 2020

(54) ALUMINUM REPAIR STATIONS AND METHODS OF USING THE SAME

(71) Applicant: Global Finishing Solutions LLC, Osseo, WI (US)

(72) Inventors: William McFadden, Barrie (CA); Michael Lampshire, Eau Claire, WI (US)

(73) Assignee: Global Finishing Solutions LLC., Osseo, WI (US)

( * ) Notice: Subject to any disclaimer, the term of this patent is extended or adjusted under 35 U.S.C. 154(b) by 228 days.

(21) Appl. No.: 14/725,362

(22) Filed: May 29, 2015

(65) Prior Publication Data

US 2015/0345811 A1 Dec. 3, 2015

Related U.S. Application Data

(60) Provisional application No. 62/004,469, filed on May 29, 2014.

(51) Int. Cl.
*F24F 7/10* (2006.01)

(52) U.S. Cl.
CPC ..... *F24F 7/10* (2013.01)

(58) Field of Classification Search
CPC ..... F24F 7/10; F24F 3/1607
USPC ..... 454/187, 237; 52/235
See application file for complete search history.

(56) References Cited

U.S. PATENT DOCUMENTS 3,824,909 A * 7/1974 Horneff ..... E04B 9/02 454/187
3,986,850 A * 10/1976 Wilcox ..... E04B 9/02 137/246
4,560,395 A * 12/1985 Davis ..... B01D 46/10 415/119
5,063,835 A * 11/1991 Rockx ..... B05B 15/1222 118/326
5,725,426 A * 3/1998 Alvarez ..... A61G 13/108 135/90

(Continued)

FOREIGN PATENT DOCUMENTS

GB 1553790 A 10/1979
RU 201126841 A 1/2013

(Continued)

OTHER PUBLICATIONS

Body Shop Business, Garmat AlumaSAFE Aluminum Repair Stations Now Included in Ford F-150 Collision Repair Program, http://www.bodyshopbusiness.com/garmat-alumasafe-aluminum-repair-stations-now-included-in-ford-f-150-collision-repair-program/, Feb. 6, 2014.*

(Continued)

*Primary Examiner* — Gregory L Huson
*Assistant Examiner* — Dana K Tighe
(74) *Attorney, Agent, or Firm* — Scherrer Patent & Trademark Law, P.C.; Stephen T. Scherrer; Monique A. Morneault

(57) ABSTRACT

The present invention relates to an aluminum repair station. More specifically, the present invention provides an enclosed area having a floor, a ceiling, and a rigid wall, and a curtain wall, said rigid wall and said curtain wall defining a perimeter of said enclosed area between the ceiling and the floor, said ceiling comprising an exhaust system for circulating air into and out of the enclosed area.

14 Claims, 6 Drawing Sheets

(56) References Cited

U.S. PATENT DOCUMENTS

| | | | | |
|---|---|---|---|---|
| 5,833,727 | A * | 11/1998 | Skarsten | B01D 46/0013 55/385.2 |
| 6,453,823 | B1 | 9/2002 | Barich et al. | |
| 6,482,083 | B1 * | 11/2002 | Nilsson | A61G 10/02 454/187 |
| 6,533,654 | B2 * | 3/2003 | DeRegge | B05B 15/1222 118/326 |
| 2012/0266812 | A1 * | 10/2012 | Iwakiri | B01D 46/2403 118/326 |

FOREIGN PATENT DOCUMENTS

| | | | |
|---|---|---|---|
| RU | 2011126841 | A | 1/2013 |
| WO | 2005020774 | A1 | 3/2005 |
| WO | 2006099999 | A1 | 9/2006 |

OTHER PUBLICATIONS

Rotunda, 2015 F-150 Collision Repair Program Aluminum Specific Tools and Equipment List and AlumaSAFE500 Brochure, http://www.certifymyshop.com/resources/common/pdf/Ford_Rotunda_Aluminum_Equipment.pdf, Jan. 21, 2014.*

International Search Report and Written Opinion, PCT Pat. App. No. PCT/US2015033193 filed May 29, 2015.

* cited by examiner

ALUMINUM REPAIR STATIONS AND METHODS OF USING THE SAME

The present invention claims priority to U.S. Provisional Patent App. No. 62/004,469, titled "Aluminum Repair Stations and Methods of Using the Same", filed May 29, 2015, which is incorporated herein by reference in its entirety.

TECHNICAL FIELD

The present invention relates to aluminum repair stations. More specifically, the present invention provides an enclosed area having a floor, a ceiling, and a curtain wall, said curtain wall defining at least a portion of a perimeter of said enclosed area between the ceiling and the floor, said ceiling comprising an exhaust system for circulating air into and out of the enclosed area.

BACKGROUND

It is common to repair aluminum items and objects that may become dented, scratched, scraped, pierced, or the like. Indeed, many automobiles and boats include a shell and other structural parts made at least in part from aluminum, due to aluminum's structural integrity and light weight. For example, Ford Motor Company's F150 Pickup truck will now feature an aluminum body, bed and supports. Thus, automobile shops, for example, require dedicated personnel and equipment designed to repair aluminum, such as aluminum automobile bodies and other like structures.

Commonly, ferrous metals and other like contaminants may interfere with aluminum welds and corrode aluminum. For example, steel particles may contaminate aluminum welds, and contaminants such as steel, chrome, zinc, manganese, boron or lead may corrode and deteriorate aluminum surfaces in a process called galvanic corrosion. Care must be taken to ensure that aluminum repair is not subject to exposure to these and other types of contaminants. Often, it is difficult to sequester aluminum parts from contaminants that may interfere with aluminum welds and otherwise may corrode or deteriorate aluminum surfaces. In addition, aluminum dust, which may be generated during aluminum repair, when mixed with iron oxide particles and/or magnesium, may combust in a thermite reaction, causing injury and damage.

A need, therefore, exists for an aluminum repair station and methods of using the same that provide separation and sequestration of aluminum parts from contaminants. More specifically, a need exists for an aluminum repair station and methods of using the same that prevent contamination of aluminum welds, and further prevent corrosion and/or deterioration of aluminum surfaces during repair of the same.

Items utilizing aluminum surfaces or structural parts are often relatively large items, such as automobiles, boats, trailers, or other like objects. Aluminum repair stations often require entire bays that must be dedicated to aluminum repair, especially to prevent contamination as noted above. It is frequently difficult to dedicate the space necessary for proper aluminum repair. Oftentimes, a dedicated space must be provided for aluminum repair that cannot be utilized for any other purpose, due to the possibility of contamination. A need, therefore, exists for an aluminum repair station and methods of using the same that is sized appropriately to handle relatively large aluminum objects, such as vehicles, boats and the like. Moreover, a need exists for an aluminum repair station and methods of using the same that may be easily set up to create an isolated work area when needed to repair aluminum.

To ensure that contamination does not occur, proper ventilation and exhaust systems must be utilized so the air within an aluminum repair area is free of contaminants, such as steel, chrome, zinc, lead, manganese and boron dust, that may interfere with aluminum welds and/or cause corrosion or deterioration of aluminum surfaces. It is often difficult to install and utilize a proper ventilation and exhaust system for ensuring the repair station air is free of contamination. A need, therefore, exists for an aluminum repair station and methods of using the same having an adequate ventilation and exhaust system to ensure the working air is free of contamination.

Moreover, typical aluminum repair stations do not have the capability to provide finishing of the aluminum parts after repair of the same. A need, therefore, exists for aluminum repair stations that provide sufficient ventilation to allow for the finishing of aluminum metal, especially aluminum metal repaired in the aluminum repair stations. More specifically, a need exists for priming aluminum metal of an object within an aluminum repair station prior to moving the object to a painting station.

SUMMARY OF THE INVENTION

The present invention relates to an aluminum repair station. More specifically, the present invention provides an enclosed area having a floor, a ceiling, and a curtain wall, said curtain wall defining at least a portion of a perimeter of said enclosed area between the ceiling and the floor, said ceiling comprising an exhaust system for circulating air into and out of the enclosed area.

To this end, in an embodiment of the present invention, an aluminum repair station is provided. The aluminum repair station comprises an enclosed area bounded by a floor, a ceiling, and a wall enclosing the perimeter of the enclosed area, said wall comprising a rigid wall portion and a curtained wall portion, wherein the curtained wall portion may be moved to open the enclosed area; an air intake for moving air into the enclosed area; an exhaust chamber in the rigid wall portion for moving air from within the enclosed area out of the enclosed area.

In an embodiment, the aluminum repair station further comprises a filter associated with the air intake for filtering the air moving into the enclosed area.

In an embodiment, the aluminum repair station further comprises a filter associated with the exhaust chamber for filtering the air moving from within the enclosed area out of the enclosed area.

In an embodiment, the ceiling is suspended and the curtained wall portion hangs from the ceiling.

In an embodiment, the curtained wall portion hangs from the ceiling on a track.

In an embodiment, the enclosed area is shaped roughly like a rectangular prism, and further wherein the curtained portion covers at least three sides of the enclosed area between the ceiling and the floor, and the rigid wall portion is disposed on the fourth side of the rectangular prism.

In an embodiment, the aluminum repair station further comprises an aperture in the rigid wall portion to direct airflow therein.

In an embodiment, the aluminum repair station further comprises a shield covering the aperture, wherein the shield is spaced a distance away from the aperture to allow airflow from within the enclosure into the aperture.

In an embodiment, the aluminum repair station further comprises a fan associated with the exhaust chamber for moving air from within the enclosed area out of the enclosed area.

In an embodiment, the aluminum repair station further comprises a fan associated with the air intake for moving air into the enclosed area.

In an embodiment, the aluminum repair station further comprises a first fan associated with the air intake for moving air into the enclosed area; and a second fan associated with the exhaust chamber for moving air from with the enclosed area out of the enclosed area.

In an embodiment, the rigid wall portion comprises a first leg, a second leg and a bridge spanning the first leg and the second leg, wherein the exhaust chamber is within at least one of the first and second legs.

In an embodiment, the aluminum repair station further comprises an exhaust stack extending from the bridge.

In an embodiment, the aluminum repair station further comprises an aperture in at least one of the first and second legs for moving air from within the enclosed area to the exhaust chamber.

In an embodiment, the aluminum repair station further comprises a first aperture in the first leg and a second aperture in the second leg for moving air from within the enclosed area to the exhaust chamber.

In an embodiment, the aluminum repair station further comprises a shield disposed over the aperture a distance from the aperture to allow airflow from within the enclosed area into the exhaust chamber.

In an embodiment, the aluminum repair station further comprises a filter within the exhaust chamber for filtering the air flowing into the exhaust chamber from the enclosed area.

In an alternate embodiment of the present invention, a system for servicing a commodity at least partially made from aluminum is provided. The system comprises an enclosed area bounded by a floor, a ceiling, and a wall enclosing the perimeter of the enclosed area, said wall comprising a rigid wall portion and a curtained wall portion, wherein the curtained wall portion may be moved to open the enclosed area, an air intake for moving air into the enclosed area, and an exhaust chamber in the rigid wall portion for moving air from within the enclosed area out of the enclosed area; and a commodity at least partially made from aluminum disposed within the enclosed area.

In an embodiment, the ceiling comprises an air intake and a first filter associated with the air intake for filtering air moving into the enclosed area, and the rigid wall portion comprises an exhaust stack and a second filter associated with the exhaust stack for filtering air moving from the enclosed area out of the enclosed area.

In an embodiment, the system further comprises a first fan for moving air through the air intake into the enclosed area, and a second fan for moving area from the enclosed area out of the enclosed area.

It is, therefore, an advantage and objective of the present invention to provide an aluminum repair station and methods of using the same that provide separation and sequestration of aluminum parts from contaminants.

More specifically, it is an advantage and objective of the present invention to provide an aluminum repair station and methods of using the same that prevent contamination of aluminum welds, and further prevent corrosion and/or deterioration of aluminum surfaces during repair of the same.

In addition, it is an advantage and objective of the present invention to provide an aluminum repair station and methods of using the same that is sized appropriately to handle relatively large aluminum objects, such as vehicles, boats and the like.

Moreover, it is an advantage and objective of the present invention to provide an aluminum repair station and methods of using the same that may be easily set up to create an isolated work area when needed to repair aluminum.

Further, it is an advantage and objective of the present invention to provide an aluminum repair station and methods of using the same having an adequate ventilation and exhaust system to ensure the working air is free of contamination.

In addition, it is an advantage and objective of the present invention to provide an aluminum repair station that provides sufficient ventilation to allow for the finishing of aluminum metal, especially aluminum metal repaired in the aluminum repair stations.

More specifically, it is an advantage and objective of the present invention to provide for priming aluminum metal of an object within an aluminum repair station prior to moving the object to a painting station.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to an aluminum repair station. More specifically, the present invention provides an enclosed area having a floor, a ceiling, and a curtain wall, said curtain wall defining at least a portion of a perimeter of said enclosed area between the ceiling and the floor, said ceiling comprising an exhaust system for circulating air into and out of the enclosed area.

Figure 1:
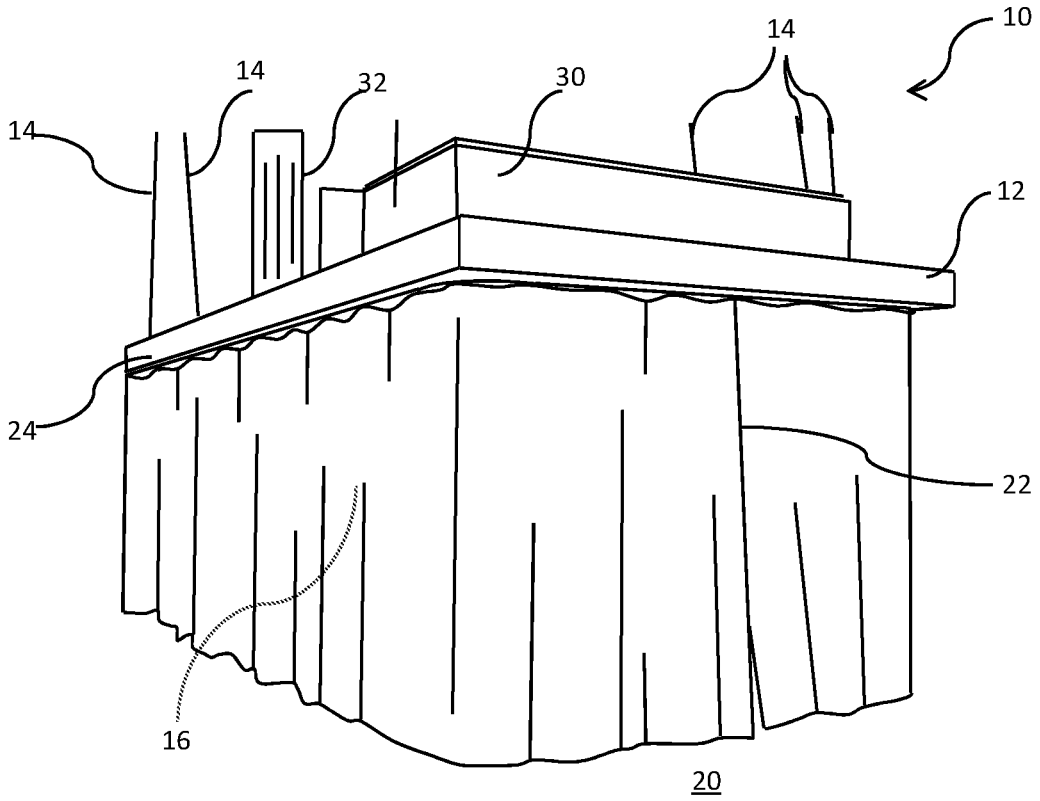
FIG. 1 illustrates a perspective view of an aluminum repair station in an embodiment of the present invention.

Now referring to the figures, wherein like numerals refer to like parts, FIG. 1 illustrates a perspective view of an aluminum repair station 10 in an embodiment of the present invention. The repair station 10 comprises a rigid ceiling 12 that may be supported by suspension via a plurality of chains or cables 14 strategically placed in various locations on an upper surface of the ceiling 12 to suspend the ceiling 12 over a work area 16. The work area 16 may be enclosed by a curtain 18 that may define a perimeter of the work area 16, and may hang from the ceiling 12 to a floor surface 20 disposed therebeneath.

The curtain 18 may preferably be made from heavy-duty, non-combustible material and may operate to isolate the work area 16 from external ambient air and, more significantly, contaminants that may be present in the ambient air. The curtain 18 may be made from any material known to those of ordinary skill in the art, and may have transparent and/or translucent areas for viewing the work area 16 therein. The curtain 18 may have an opening 22 where two ends of the curtain meet at a front thereof for allowing passage of objects and/or individuals therethrough. The curtain 18 may have a connecting means, such as ties, closures, zippers, magnets, or other like connecting means for connecting the ends of the curtain 18 together to close the opening 22 to prevent passage of contaminants therethrough. Alternatively, the curtain 18 may be freely hanging without a connecting means, where simply hanging together provides sufficient closure of the opening to prevent contaminants from entering the isolated work area 16.

The curtain 18 may be suspended on a track 24 to allow the curtain 18 to be moved. For example, the ends of the curtain that meet at or near the opening 22 may diverge from each other so that the opening 22 may become larger, allowing passage of vehicles or other objects requiring aluminum repair. After passage of the object therethrough, the curtain 18 may be closed to isolate the work area 16, especially when conducting the aluminum repair in the work area 16. Preferably, the curtain 18 may hang from rollers that allow for easy movement of the curtain 18 along the track 24. The curtain 18 may be a single curtain that wraps fully around the perimeter of the work area 16, or may comprise two or more curtains that may, in concert, wrap fully around the perimeter of the work area 16.

Disposed on a top surface of the ceiling 18 may be a intake fan box 30 that may hold a fan or other air movement means (not shown), for pulling ambient air into the isolated work area 16 and circulating the same through and out of the isolated work area through an exhaust stack 32. A second fan or other air movement means (not shown) may be disposed in the exhaust stack 32 for pulling air out of the isolated work area 16. To ensure that the air forced into the isolated work area 16 is free of contaminants, the intake fan box 30 may further hold one or more filters that may effectively remove the contaminants from the ambient air prior to entering the isolated work area 16. In addition, the second fan or other air movement means (not shown) within the exhaust stack 32 may operate to ensure a continuous cycle of air movement through the isolated work area 16, thereby removing from the isolated work area 16 paint fumes, volatile chemicals, or any other like material that may be generated via the aluminum repair conducted therein. The exhaust stack 32 may eject the air from within the isolated work area 16 into the open air, or may otherwise be processed for ensuring that the same is clean prior to ejecting into the environment.

Figure 2:
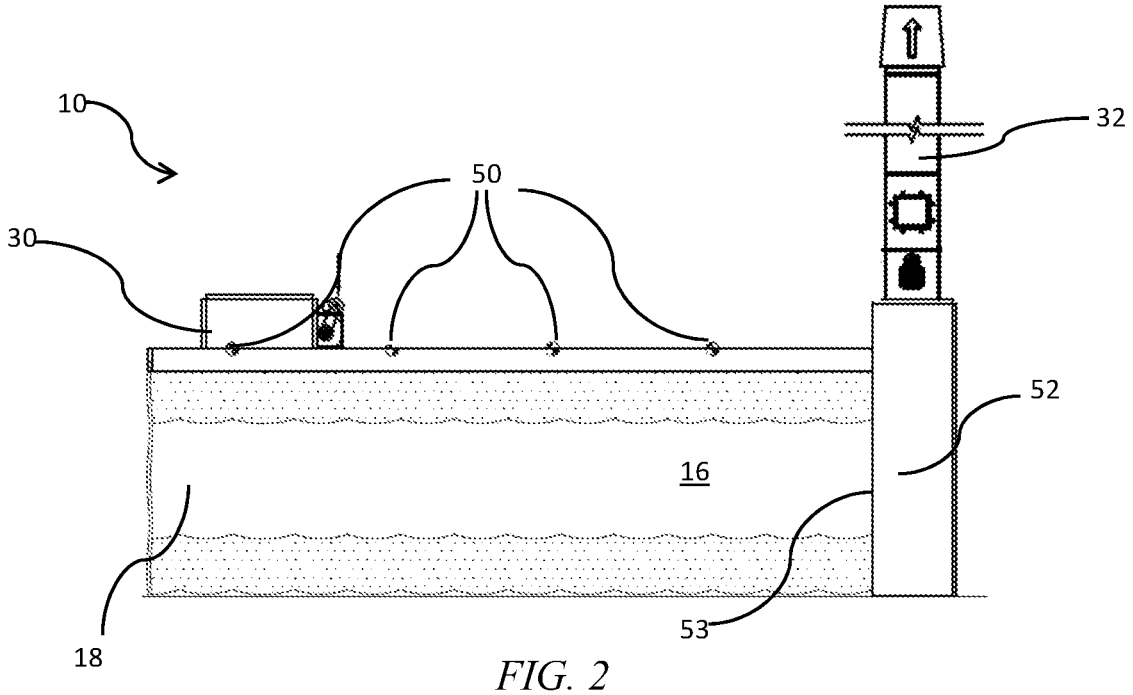
FIG. 2 illustrates a side elevation view of an aluminum repair station with hanging points in an embodiment of the present invention.

FIG. 2 illustrates a side elevation view of the aluminum repair station 10 in an embodiment of the present invention. The ceiling 12 may be suspended at various hanging points 50 disposed around the top surface of the ceiling, ensuring that the ceiling is stable and safe. Of course, the number of hanging points 50 and respective cables attached to those hanging points 50 may be increased for larger repair stations or decreased for smaller repair stations, as apparent to one of ordinary skill in the art.

Disposed at a rear of the repair station 10 may be an exhaust chamber 52 that may effectively frame the rear portion of the repair station 10. The exhaust chamber 52 may provide stability and an anchor for the repair station 10 to keep the same from moving as it is suspended. Moreover, the exhaust chamber 52 may hold the exhaust stack 32 and the exhaust fan may be disposed thereon for pulling air from the work area 16 through the exhaust stack 32. Of course, the size and power of the exhaust fan or other air moving apparatus may be dependent on the size of the work area 16 created by the repair station 10, as disclosed herein. Likewise, the intake fan or other air moving apparatus disposed in the intake fan box 30, disposed near the front of the repair station 10, may further be dependent on the size of the work area 16 and the amount of air that must be moved for circulation thereof.

Figure 4:
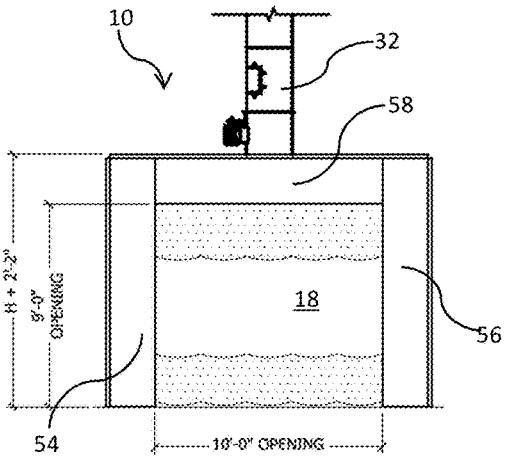
FIG. 4 illustrates a rear elevation view of an aluminum repair station with hanging points in an embodiment of the present invention.
Figure 8:
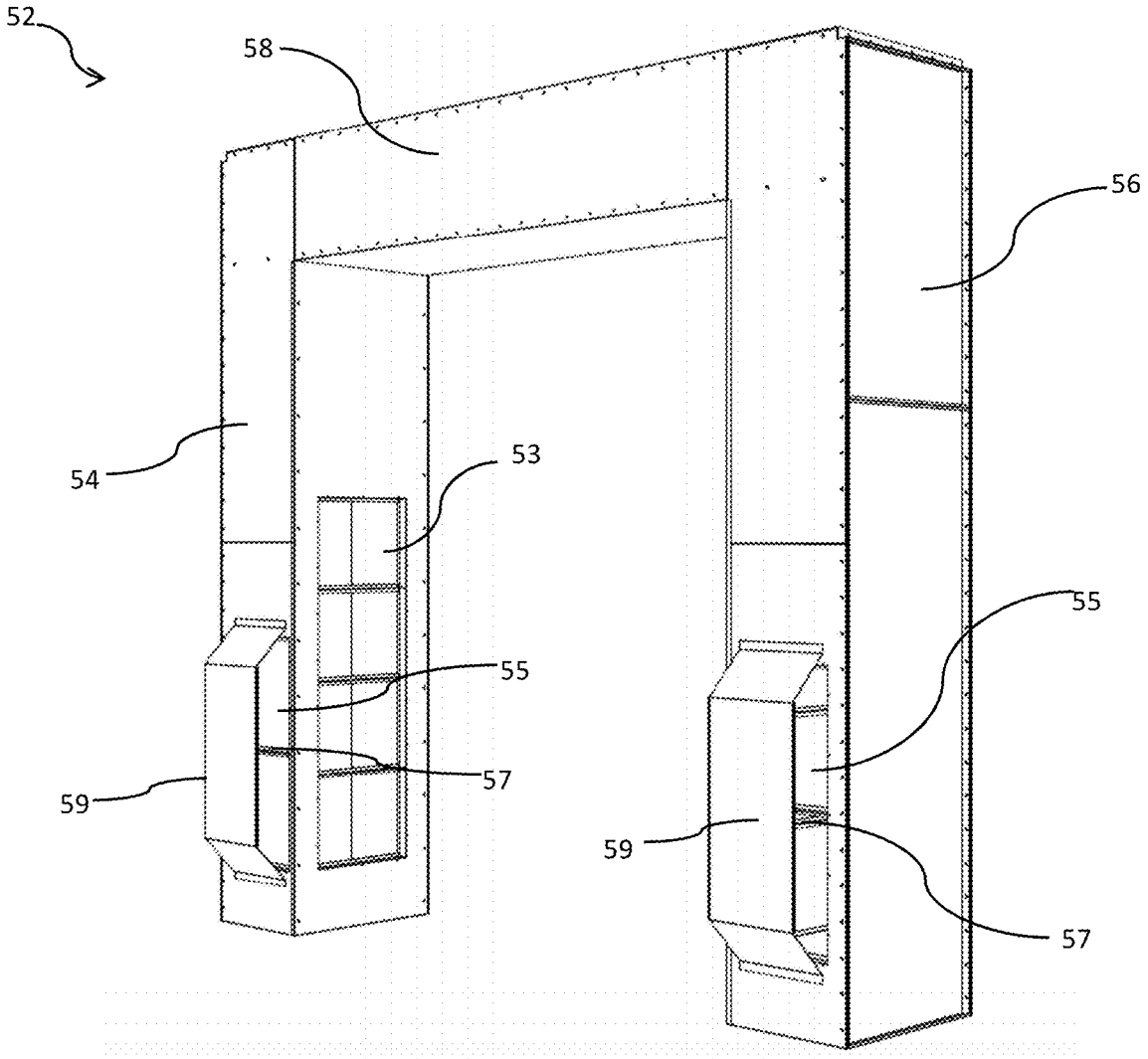
FIG. 8 illustrates a perspective view of an exhaust chamber for an aluminum repair station in an embodiment of the present invention.

The exhaust chamber 52 may be relatively solid and have a rigid wall portion 53 facing the inside of the work area 16 and may be disposed across the rear of the repair station 10. Shelves or other like features may be in or around the exhaust chamber 52 for holding tools and other like materials necessary for conducting aluminum repair. As illustrated in FIGS. 4 and 8, the exhaust chamber 52 may comprise a first leg 54, a second leg 56, each of which may be disposed in a respective corner of the rear of the repair station 10, and a bridge 58 spanning the first leg 54 and the second leg 56 for holding the exhaust stack 32 and any related equipment thereon, such as the exhaust fan.

FIG. 8 illustrates a perspective view of the exhaust chamber 52 in an embodiment of the present invention. As disclosed above, the exhaust chamber 52 may comprise the first leg 54, the second leg 56, and a bridge 58 spanning the first leg 54 and the second 56. The exhaust stack 32, not shown in FIG. 8, may extend upwardly from a top of the bridge 58. The exhaust chamber 52 may have include one or more exhaust plenum and/or filters that may be utilized to remove overspray within the work area 16 in the event the work area 16 is utilized to prime and/or paint articles.

Disposed in leg 54, leg 56 or both legs 54, 56, may be an area containing a plurality of exhaust filters 53 that may be utilized for removing contaminants from the circulated air prior to exhaustion of the same outside of the work area 16. Except for the exhaust filters 53 that may be built into the legs 54, 56, the legs 54, 56 and bridge 58 may be hollow, or otherwise have pipes for moving air from within the work area 16 through the wall 52 and out of the work area 16 through the exhaust stack 32.

One or more exhaust plenum 55 may be incorporated into the legs 54, 56 for drawing air from within the work area 16 and exhausting the air through exhaust stack 32. It should be noted that the repair station 10 may preferably meet the criteria of a limited finishing workstation as defined by NFPA 33, and may be utilized in alternately as a repair area and a limited spray area. Exhaust filters 53 may be provided, as disclosed above, within the plenum 55 for removal of overspray and/or other material contained in the air of the work area 16, prior to exhausting through the exhaust stack 32. Exhaust filter shields 57 may be placed over the plenum 55 for protecting the plenum and/or filters contained therein to ensure that the filters 53 are protected from large particles and/or sparks that may be generated within the work area 16.

Figure 9:
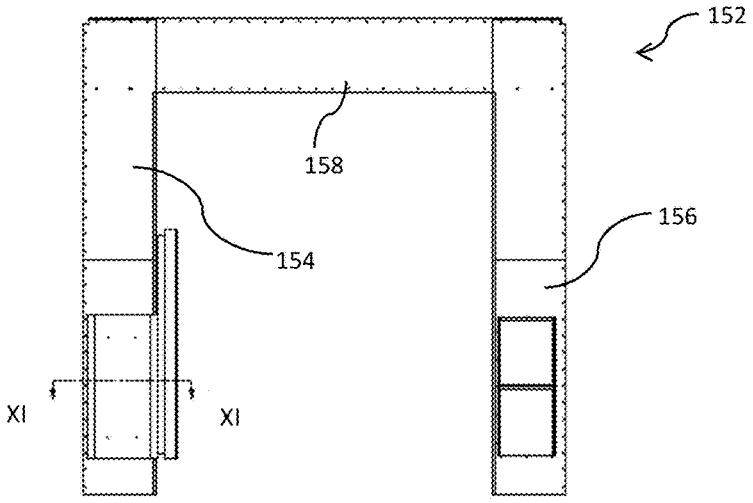
FIG. 9 illustrates a front view of an exhaust chamber for an aluminum repair station in an embodiment of the present invention.
Figure 11:
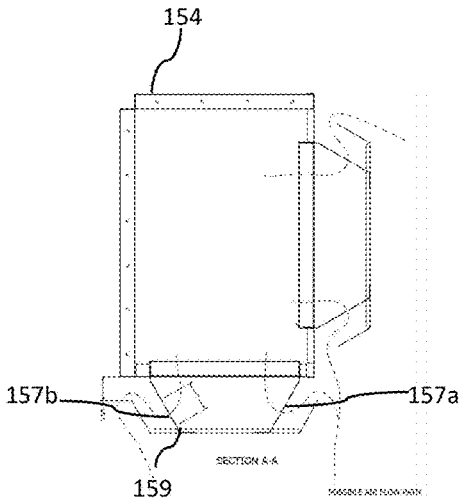
FIG. 11 illustrates a cross-sectional view of a leg of an exhaust chamber for an aluminum repair station in an embodiment of the present invention.
Figure 10:
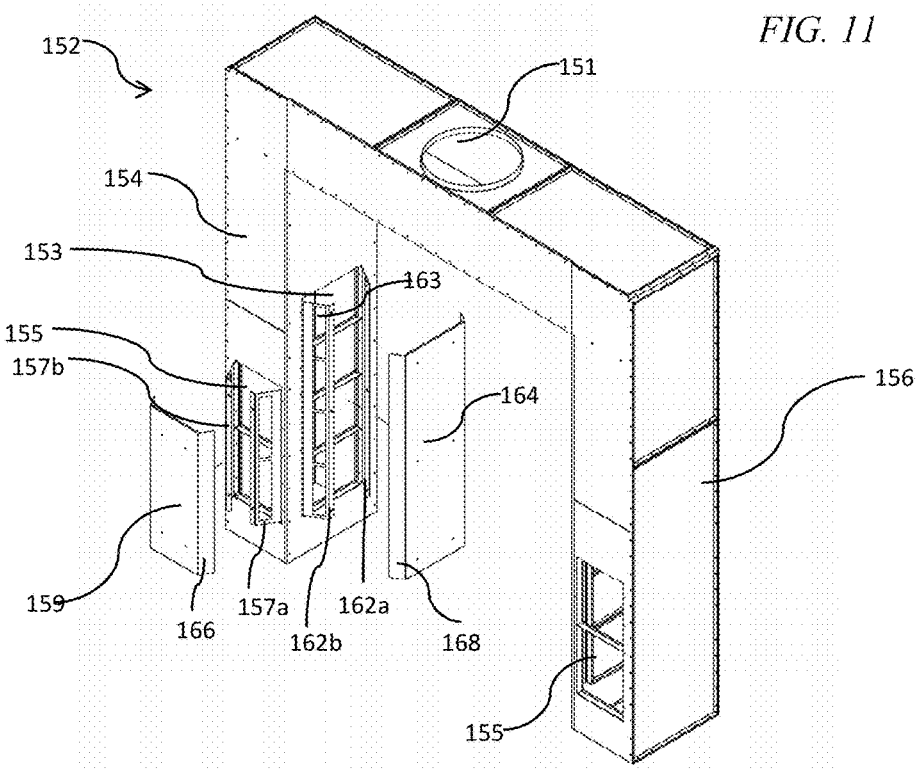
FIG. 10 illustrates an exploded perspective view of an exhaust chamber for an aluminum repair station in an embodiment of the present invention.

In an alternate embodiment of the present invention, illustrated in FIGS. 9-11, an exhaust chamber 152 is illustrated, similar to the exhaust chamber 52 disclosed above. Specifically, the exhaust chamber 152 may comprise first and second legs 154, 156 and a bridge 158 spanning the first leg 154 and the second leg 156, forming a hollow interior whereby airflow may exhaust through an exhaust stack (not shown) that is disposed on a hole 151 within the bridge 158.

The exhaust chamber 152 may comprise a plenum 153 disposed on an inside of one or both of legs 154, 156, and a plenum 155 disposed on a front side of one or both of the legs 154, 156. The plenum 155 may contain one or more filters for filtering material from air that flows therein. A pair of support angles 157*a*, 157*b* may extend from the sides of the plenum 155 for holding a shield 159 a distance from the first and second legs 154, 156. The support angles 157*a*, 157*b* may extend outwardly at an angle, and may further have one or more apertures 160 therein for allowing airflow therethrough, as illustrated in the cross-sectional view XI-XI, as illustrated in FIG. 11.

Likewise, plenum 153 may have one or more filters therein for filtering air flowing therein, and may further have a pair of supports 162*a*, 162*b* extending outwardly from the sides of plenum 153 having apertures 163 and holding a shield 164 a length from the inside of the leg 154. The shields 159, 164 may be attached to the respective pairs of supports 157*a*, 157*b* and 162*a*, 162*b* via bolts, rivets, screws, or other like connecting means.

The shields 159, 164 may have angled flanges 166, 168 respectively extending from the shields to at least partially cover the apertures 160, 163, respectively, and provides a serpentine path for airflow around the shields 159, 164, through the apertures 160, 163, into the leg 153, and out the exhaust. Thus, filters contained therein may be protected from particles or other material, as the serpentine path may prevent material from entering the plenums 153, 155.

Figure 12:
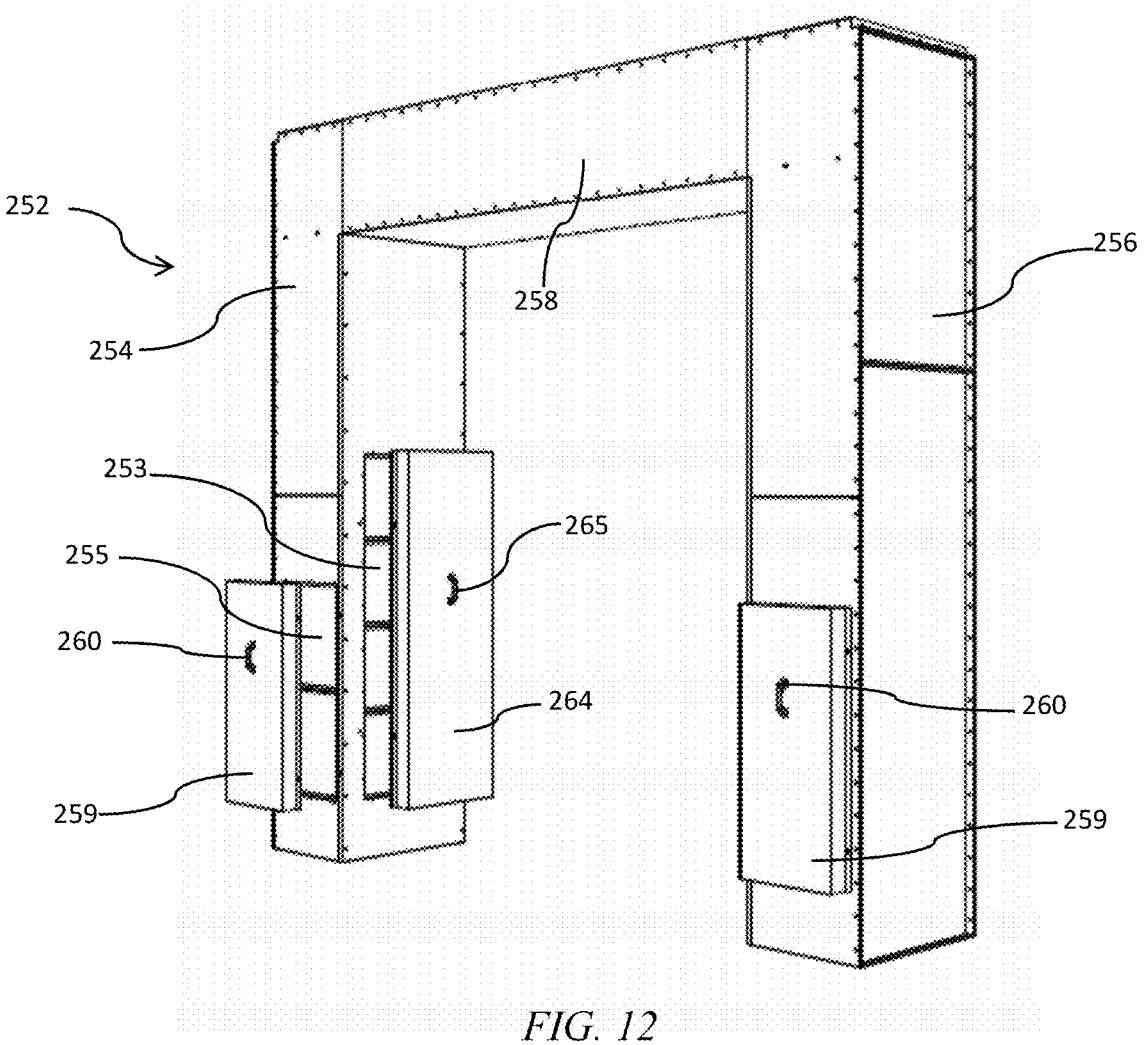
FIG. 12 illustrates a perspective view of an exhaust chamber for an aluminum repair station in an embodiment of the present invention.

FIG. 12 illustrates yet another alternate embodiment of the present invention, of an exhaust chamber 252 that is similar to the exhaust chambers 52, 152 disclosed above. Specifically, the exhaust chamber 252 may comprise first and second legs 254, 256 and a bridge 258 spanning the first and second legs 254, 256, forming a hollow interior whereby airflow may exhaust through an exhaust stack (not shown) that is disposed over a hole (not shown) in the bridge 258.

The exhaust chamber 252 may comprise a plenum 253 disposed on an inside of one or both of legs 254, 256, and a plenum 255 disposed on a front side of one or both of legs 254, 256. The plenum 253 may contain one or more filters for filtering air that flows therein. Likewise, the plenum 255 may also contain one or more filters for filtering air the flows therein. Shields 259, 264 may be disposed over the plena 253, 255 when it is desired to protect the plena 253, 255 and the filters inside. Specifically, during periods of time where a metal commodity is being worked on within the interior space 16, the shields 259, 264 may be disposed over the plena 253, 255 to protect the filters from metal debris that may be in the air. During times of spraying, the shields 259, 264 may be removed, allowing the exhaust to flow through the plena 253, 255. Thus, the shields 259, 264 may be rigidly attached over the plena 255, 253, respectively, such as via pins, bolts, screws, hooks, or other like attaching means. Handles 260, 265 disposed on the shields 259, 264, respectively, may aid in the attachment to and/or removal from the legs 254, 256.

Figure 3:
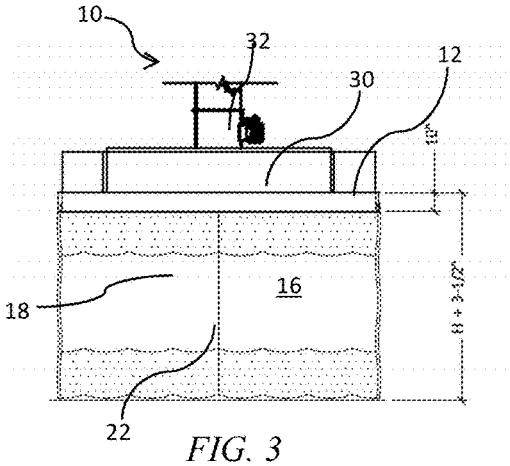
FIG. 3 illustrates a front elevation view of an aluminum repair station with hanging points in an embodiment of the present invention.

FIG. 3 illustrates a front elevation view of the repair station 10, showing the ceiling 12 suspending the curtain 18, and the opening 22 wherein the ends of the curtain 18 meet. The fan intake box 30 is further shown, disposed at a front of the repair station 10, and the exhaust stack 32 is further shown.

Figure 5:
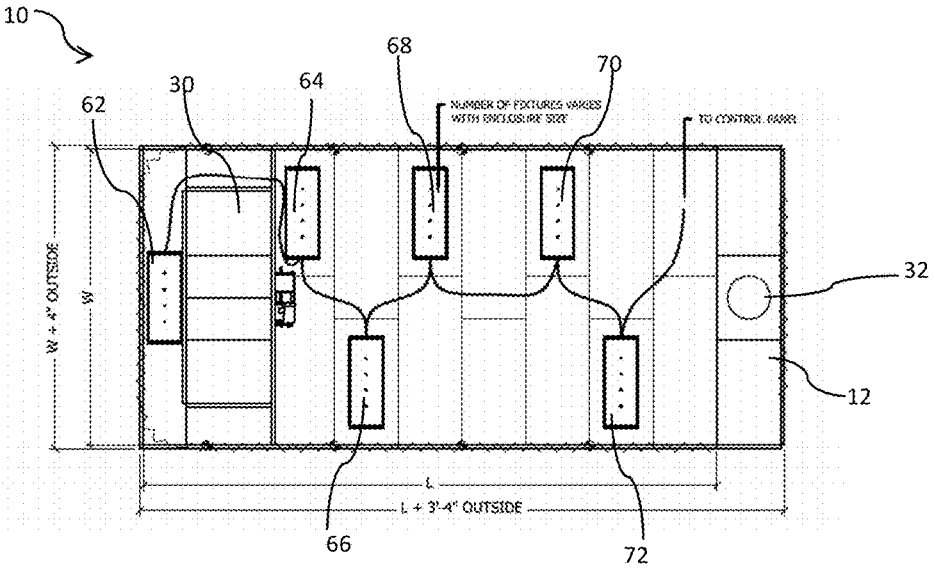
FIG. 5 illustrates a plan view of a ceiling for an aluminum repair station with hanging points in an embodiment of the present invention.

FIG. 5 illustrates a plan view of a top surface of the ceiling 12 in an embodiment of the present invention. The ceiling 12 may have the fan intake box 30 and the exhaust stack 32, as disclosed above. Moreover, the ceiling 12 may have a plurality of light fixtures 62, 64, 66, 68, 70 and 72 for illuminating the work area 16. The light fixtures may be wired to each other and/or to a control panel (not shown) where the lights in the light fixtures 62-72 may be turned on or off. The light fixtures 62-72 may be strategically positioned to provide full illumination downward into the isolated work area 16 so that individuals working therein have sufficient lighting to conduct aluminum repair. It should be noted that although six light fixtures are illustrated in FIG. 5, the ceiling 12 may contain any number of light fixtures and lights to ensure adequate illumination of the work area 16.

Thus, the aluminum repair station 10 may effectively isolate the work area 16 from the ambient air and contaminants that may be contained in the ambient air, and may further provide an adequate illuminated work area, and circulated filtered air therethrough to remove dust, volatile chemicals, and other like materials when generated therein. Therefore, aluminum objects, such as surfaces and structures, may be safely repaired without ferrous contamination or contamination from other sources, and further may be primed or finished prior to moving the objects into a paint area.

Figure 6:
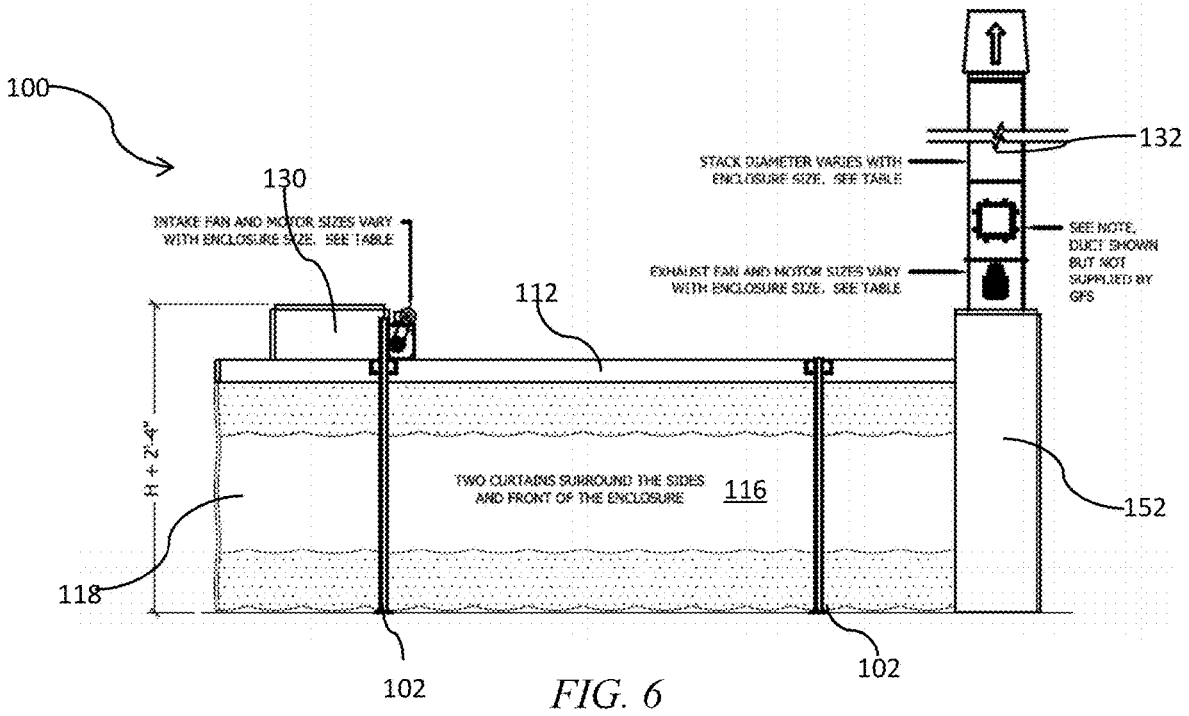
FIG. 6 illustrates a side elevation view of an aluminum repair station with support posts or columns in an alternate embodiment of the present invention.
Figure 7:
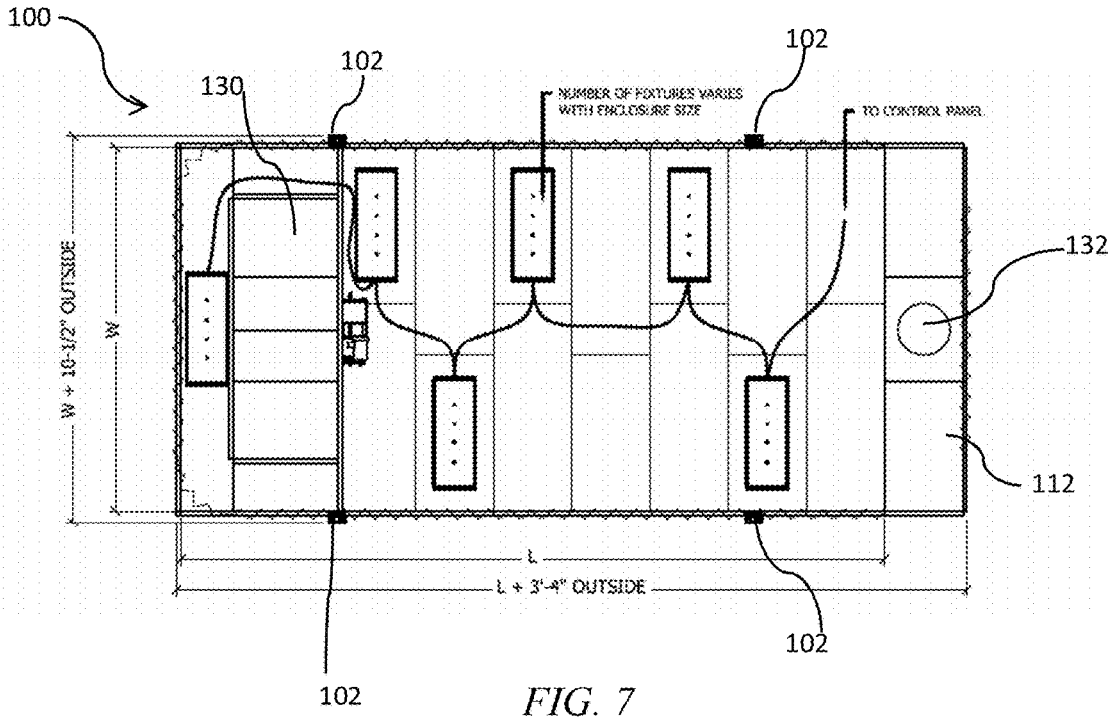
FIG. 7 illustrates a plan view of a ceiling for an aluminum repair station with support columns in an alternate embodiment of the present invention.

FIG. 6 illustrates a side elevation view of an aluminum repair station 100 in an alternate embodiment of the present invention. The aluminum repair station 100 may have a ceiling 112, a fan intake box 130, an exhaust stack 132, one or more curtains 118 defining a work area 116, and the exhaust chamber 152, similar to the respective elements described above with respect to the aluminum repair station 10. However, the repair station 100 may have a plurality of rigid posts or columns 102 that may be utilized to hold the ceiling 112 above the work area 116, rather than having the ceiling suspended as described above. The posts 102 may be strategically placed at various locations around the ceiling 112 and rigidly held thereto to hold the ceiling 112 in place. The curtain 118 may be disposed around the perimeter of the work area 116 on the insides of the posts 102 so that the posts 102 do not interfere with the movement of the curtain 118.

The aluminum repair stations described herein may be any size apparent to one of ordinary skill in the art, and may depend on the size of objects repaired therein, space restrictions, and any other parameter useful to determine the size of the aluminum repair station needed. Preferably, the aluminum repair station, as described herein, may be sized to ensure full enclosure of the object within the repair station so that the object may be effectively isolated from ambient air while repair work is conducted thereon.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. An aluminum repair station comprising:

an enclosed area bounded by a floor, a ceiling, and a wall enclosing a perimeter of the enclosed area, said wall comprising a rigid wall portion and a curtained wall portion, wherein the curtained wall portion may be moved to open the enclosed area;

an air intake for moving air into the enclosed area;

an exhaust chamber in the rigid wall portion for moving the air from within the enclosed area out of the enclosed area;

an aperture in the rigid wall portion to direct airflow therein;

at least one leg extending from the rigid wall portion;

a shield attached to the at least one leg covering the aperture, wherein the shield is spaced a distance away from the aperture to allow the air to flow from within the enclosure into the aperture, wherein the leg and the shield are configured to define a serpentine path for the air to flow from the enclosure into the aperture; and a filter within the exhaust chamber configured to filter the air directed along the serpentine path from the enclosure into the aperture.

2. The aluminum repair station of claim 1 further comprising:

a filter associated with the air intake for filtering the air moving into the enclosed area.

3. The aluminum repair station of claim 1 wherein the ceiling is suspended and the curtained wall portion hangs from the ceiling.

4. The aluminum repair station of claim 1 wherein the curtained wall portion hangs from the ceiling on a track.

5. The aluminum repair station of claim 1 wherein the enclosed area is shaped roughly like a rectangular prism, and further wherein the curtained wall portion covers at least three sides of the enclosed area between the ceiling and the floor, and the rigid wall portion is disposed on a fourth side of the rectangular prism.

6. The aluminum repair station of claim 1 further comprising:

a fan associated with the exhaust chamber for moving the air from within the enclosed area into the aperture.

7. The aluminum repair station of claim 1 further comprising:

a fan associated with the air intake for moving the air into the enclosed area.

8. The aluminum repair station of claim 1 further comprising:

a first fan associated with the air intake for moving the air into the enclosed area; and a second fan associated with the exhaust chamber for moving the air from within the enclosed area into the aperture.

9. The aluminum repair station of claim 1 wherein the rigid wall portion comprises a first leg, a second leg and a bridge spanning the first leg and the second leg, wherein the exhaust chamber is within at least one of the first and second legs.

10. The aluminum repair station of claim 9 further comprising:

an exhaust stack extending from the bridge.

11. The aluminum repair station of claim 9 wherein the aperture is disposed in the first leg.

12. The aluminum repair station of claim 11 further comprising:

a second aperture in the second leg for moving the air from within the enclosed area to the exhaust chamber.

13. The aluminum repair station of claim 12 further comprising:

a second shield disposed over the second aperture a distance from the second aperture to allow airflow from within the enclosed area into the exhaust chamber.

14. The aluminum repair station of claim 12 further comprising:

a second filter within the exhaust chamber for filtering the air flowing into the exhaust chamber from the enclosed area through the second aperture.

* * * * *